US006942207B2

(12) United States Patent
Katou et al.

(10) Patent No.: US 6,942,207 B2
(45) Date of Patent: Sep. 13, 2005

(54) BILL RECEIVING/DISPENSING BOX

(75) Inventors: Riichi Katou, Nagoya (JP); Akira Nomiyama, Kashiwa (JP); Shinji Shibata, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 17 days.

(21) Appl. No.: 10/385,634

(22) Filed: Mar. 12, 2003

(65) Prior Publication Data

US 2003/0173183 A1 Sep. 18, 2003

Related U.S. Application Data

(63) Continuation of application No. 09/851,996, filed on May 10, 2001, now Pat. No. 6,533,261.

(30) Foreign Application Priority Data

May 19, 2000 (JP) ..... 2000-152745

(51) Int. Cl.[7] ..... B65H 5/22
(52) U.S. Cl. ..... 271/3.01; 271/3.14; 271/4.01
(58) Field of Search ..... 271/3.12, 3.13, 271/149, 152, 155, 163, 177, 178, 3.01, 3.08, 3.05, 3.14, 4.01; 209/534

(56) References Cited

U.S. PATENT DOCUMENTS 5,100,022 A * 3/1992 Fukudome et al. ..... 221/198
5,104,109 A * 4/1992 Kubo ..... 271/3.12
5,398,931 A 3/1995 Tohgoh
5,451,038 A * 9/1995 Hosking et al. ..... 271/3.01
5,476,254 A 12/1995 Golicz
5,957,448 A * 9/1999 Frank et al. ..... 271/152
6,155,556 A 12/2000 Lynch et al.
6,168,151 B1 1/2001 Tsuchida
6,334,610 B1 1/2002 Minamishin et al.
6,533,261 B2 * 3/2003 Katou et al. ..... 271/3.12

FOREIGN PATENT DOCUMENTS

JP 10-188074 A 7/1998

* cited by examiner

*Primary Examiner*—David H. Bollinger
(74) *Attorney, Agent, or Firm*—Antonelli, Terry, Stout & Kraus, LLP.

(57) ABSTRACT

A recycle box to be mounted on a bill receiving/dispensing machine including a bill convey path, includes a stacking/separating mechanism arranged to receive bills from the bill convey path so that the bills are contained in the recycle box, and to separate at least one of the bills from the bills contained in the recycle box so that the at least one of the bills is fed to the bill convey path from the recycle box, and a swingable bill guide arranged in the vicinity of the stacking/separating mechanism.

18 Claims, 8 Drawing Sheets

CONTROL BLOCK DIAGRAM FOR AUTOMATIC TELLER MACHINE 101

CONTROL BLOCK DIAGRAM FOR BILL RECEIVING / DISPENSING MACHINE

BILL RECEIVING/DISPENSING BOX

CROSS REFERENCE TO RELATED APPLICATION

This is a continuation of U.S. application Ser. No. 09/851,996, filed May 10, 2001, now U.S. Pat. No. 6,533,261, the subject matter of which is incorporated by reference herein.

BACKGROUND OF THE INVENTION

The invention relates to a bill receiving/dispensing machine (for example, an ATM used by banking organs or the like), from and to which general users make use of cards, passbooks, or the like to directly receive and pay cash, and more particularly, to a bill receiving/dispensing box used for return-type bill receiving/dispensing machines, in which received bills are used as bills being dispensed.

Conventionally, in bill receiving/dispensing machines for return-type ATMs used in banking organs or the like, vertical-type bill receiving/dispensing boxes are commonly employed to be placed at the services of storage of received bills, delivery of bills being paid, automatic recovery of bills from the machine, automatic recovery of bills from the machine, automatic charging of bills to the machine, automatic inspection for determining cash remaining in the machine, or the like. Meanwhile, there has been proposed a system, in which horizontal-type bill receiving/dispensing boxes are stacked in a plurality of stages on account of an advantage that an entire installation can be composed of a relatively simple conveying system and bill receiving/dispensing boxes can be increased in number without a change is installation area.

For example, Japanese Patent Unexamined Publication No. 18807/1998 shows a construction of a bill receiving/dispensing machine, which employs horizontal bill receiving/dispensing boxes.

SUMMARY OF THE INVENTION

As ATMs or the like have spread, there has been an increasing demand for bill receiving/dispensing machines, which are smaller in size, lower in cost, and easier of use while ensuring conventional functions and performance. Meanwhile, as foreign bills have been increasingly accepted in Japan and there has been an increasing demand for bill receiving/dispensing machines in foreign countries, an installation capable of handling not only Japanese Yen bills but also foreign bills has been demanded.

For the purposes of simplification of a mechanism for smaller size and lower cost and enhancement of reliability and operability, the following points must be adequately taken into consideration with respect to bill receiving/dispensing boxes, which are mounted on the above-described bill receiving/dispensing machines. It is necessary for bill receiving/dispensing boxes to store and discharge bills in a state, in which as many as 2000 to 3000 bills are stored and store and discharge bent or broken bills generated during circulation and foreign bills having different paper quality. For such purposes, it is important (1) to stably hold various, many bills stored in an aligned state, (2) to surely conduct the stored bills to a separation mechanism section at the time of separating operation and let out the same, (3) to move bills having been stored in a direction away from a stack mechanism section at the time of stacking operation to ensure a storage space for bills to be stacked to align and stack bills, and (4) to enable a staff to align and set bills in a state, in which bills neither fall nor incline, when the staff charges bills in a storage section.

Meanwhile, with the above-described prior art, the reliability of machine, there has not been taken into consideration reliability of an installation, in particular, reliability when bills act when a large number of bills are handled and under unfavorable conditions in terms of circulation.

It is an object of the invention to provide a bill receiving/dispensing box capable of performing stable separating and stacking actions for a large number of bills and for bills under unfavorable condition due to circulation, and having a good operability, with which a staff charges bills in a storage section.

To attain the above object, the bill receiving/dispensing box in accordance with the invention comprises a stacking/separating mechanism connected to a bill conveying path outside of the bill receiving/dispensing box, and for storing bills in the bill receiving/dispensing box and separating bills from the bill receiving/dispensing box, and a push plate for supporting a side of stacked bills opposite to the stacking/separating mechanism, and for driving bills toward the stacking/separating mechanism when bill are to be separated, and keeping bills away from the stacking/separating mechanism to drive the same toward a storage space formed when bills are to be stacked. Also, the bill receiving/dispensing box comprises a bill guide adapted to abut against a side of stacked bills toward the stacking/separating mechanism, and for moving bills to a position, where a bill is conducted to the stacking/separating mechanism, when bills are to be separated, and keeping bills away from the stacking/separating mechanism to move the same to a position, where a storage space is formed, when bills are to be stacked. Further, the bill receiving/dispensing box employs a push plate and bill guide interlocking mechanism adapted to interlock with the push plate, which moves stacked bills toward and against the stacking/separating mechanism, when bills are to be separated, to move the bill guide to a position where a bill is conducted to the stacking/separating mechanism, and adapted to interlockingly drive the push plate and the bill guide so as to interlock with the push plate, which keeps stacked bills away from the stacking/separating mechanism to drive the same to a position where a storage space is formed, when bills are to be separated.

DESCRIPTION OF THE EMBODIMENTS

An embodiment of the invention will now be described in detail with reference to the accompanying drawings.

Figure 1:
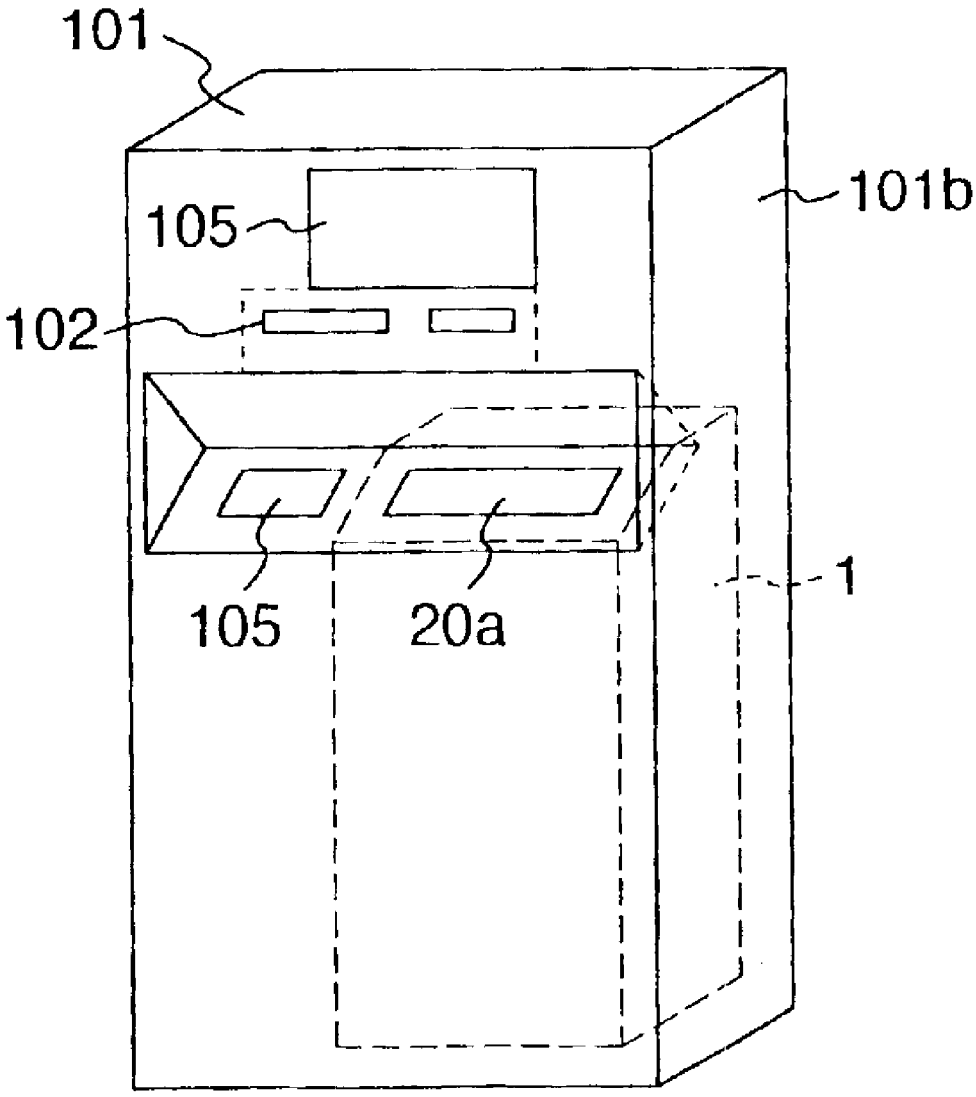
FIG. 1 is a schematic perspective view showing an automatic teller machine mounting thereon a bill receiving/dispensing mechanism.

FIG. 1 is a perspective view showing an external appearance of an automatic teller machine, to which the invention is applied. An automatic teller machine 101 comprises in an upper and interior part thereof a card/detail sheet processing mechanism 102 and a customer operation section 105. Also, the automatic teller machine 101 further comprises in a lower and interior part thereof a bill receiving/dispensing machine 1 for processing bills, and a bill slot 20*a* on a front. This automatic teller machine 101 can perform processing for deposit, payment, transfer, or the like by a customer with a card, a bill, and a detail sheet.

Figure 2:
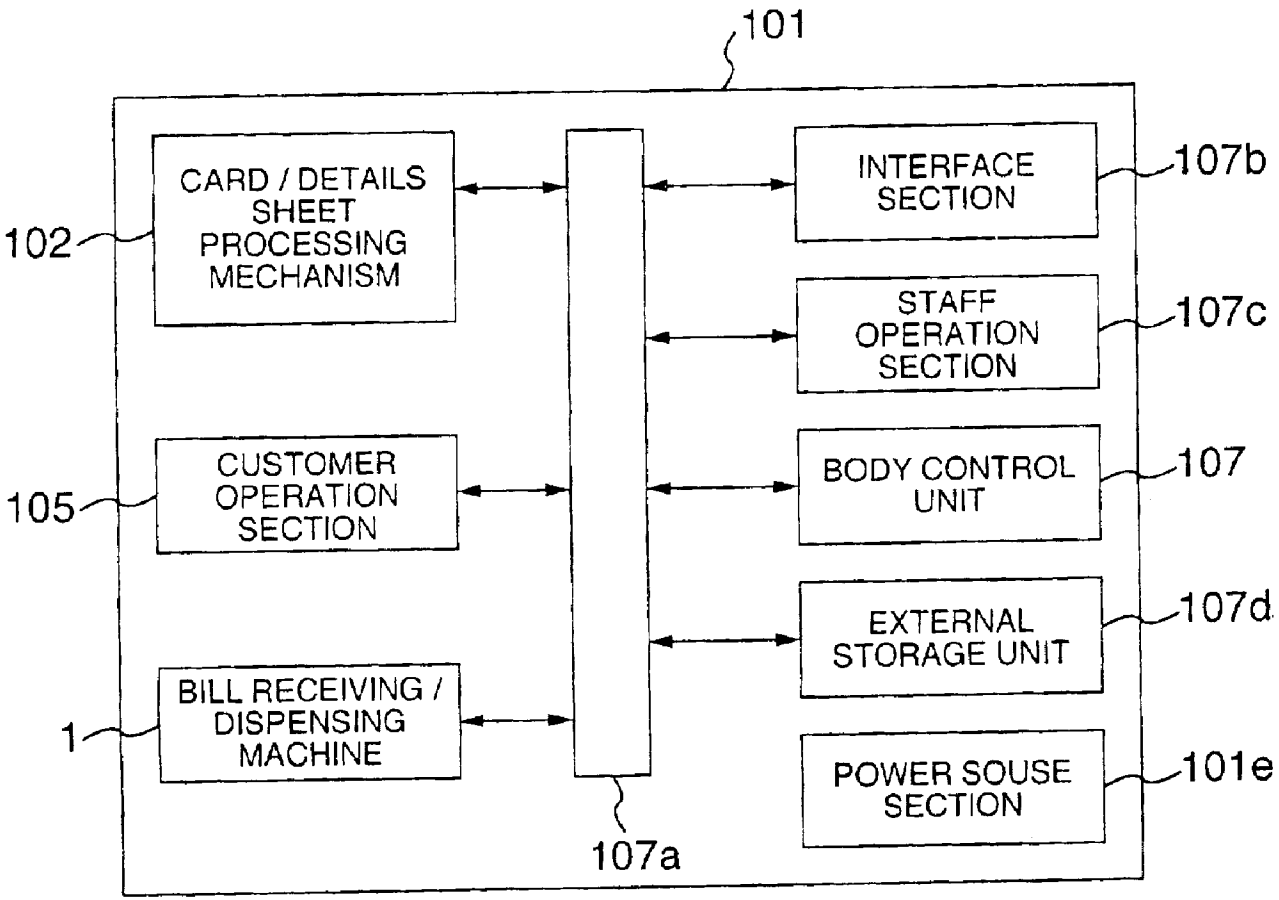
FIG. 2 is a block diagram showing the control relationship of an automatic teller machine.

FIG. 2 is a control block diagram showing the control relationship in this machine. As described above, the card/detail sheet processing mechanism 102, the bill receiving/dispensing machine 1, and the customer operation section 105, which are contained in the automatic teller machine 101, are connected to a body control unit 107 to perform necessary operations under the control of the body control unit 107.

Figure 3:
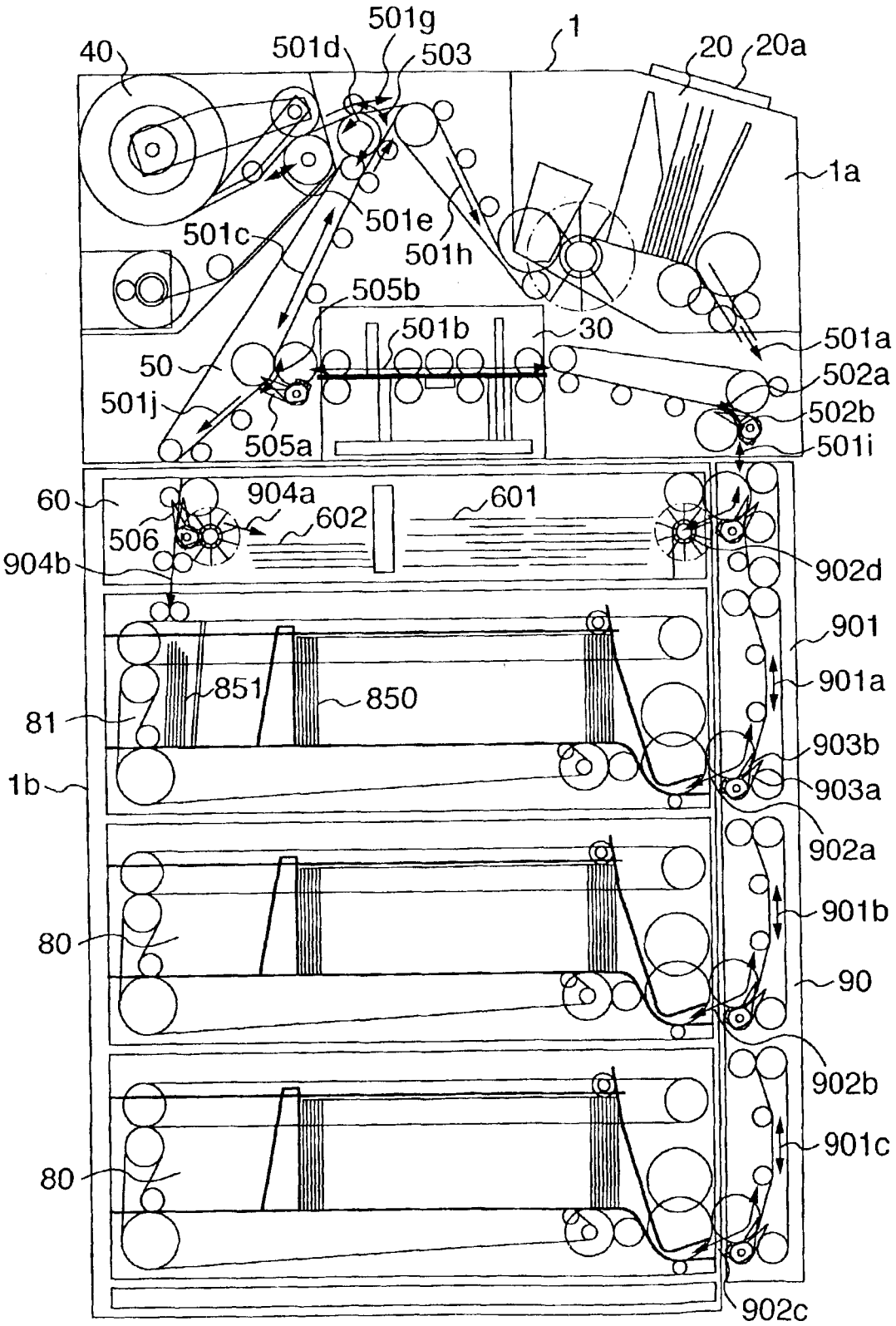
FIG. 3 is a side view showing an embodiment of a bill receiving/dispensing mechanism.

FIG. 3 is a side view showing the construction of the bill receiving/dispensing machine 1 according to the invention, which is provided in the automatic teller machine shown in FIG. 1. The bill receiving/dispensing machine 1 comprises a money deposit and payment port 20, through which a customer charges and takes out bills, a bill discriminating section 30 for discriminating bills, a temporary storage section 40 for temporarily storing deposited bills until a transaction is concluded, two recycle boxes 80 for storing bills, for which a transaction is concluded, at the time of reception and for placing these bills at the service of payment, a reject box 60 for storing bills not placed at the service of reception and payment, a charge/recovery box 81 for storing bills being replenished into the recycle boxes 80 and bills being recovered from the recycle boxes 80, a bill conveying path 50, along which bills are conveyed to the money deposit and payment port 20, the temporary storage box 40, the reject box 60, the recycle boxes 80 and the charge/recovery box 81 through the bill discriminating section 30, and a control unit (not shown).

Hereupon, the recycle boxes 80 and the charge/recovery box 81 constitute a bill receiving/dispensing box, to which the invention is applied, each having a storage space for about 2500 bills and housing a stacking/separating mechanism. The charge/recovery box 81 differs from the recycle box 80 in that a charge reject section described later is included.

Figure 4:
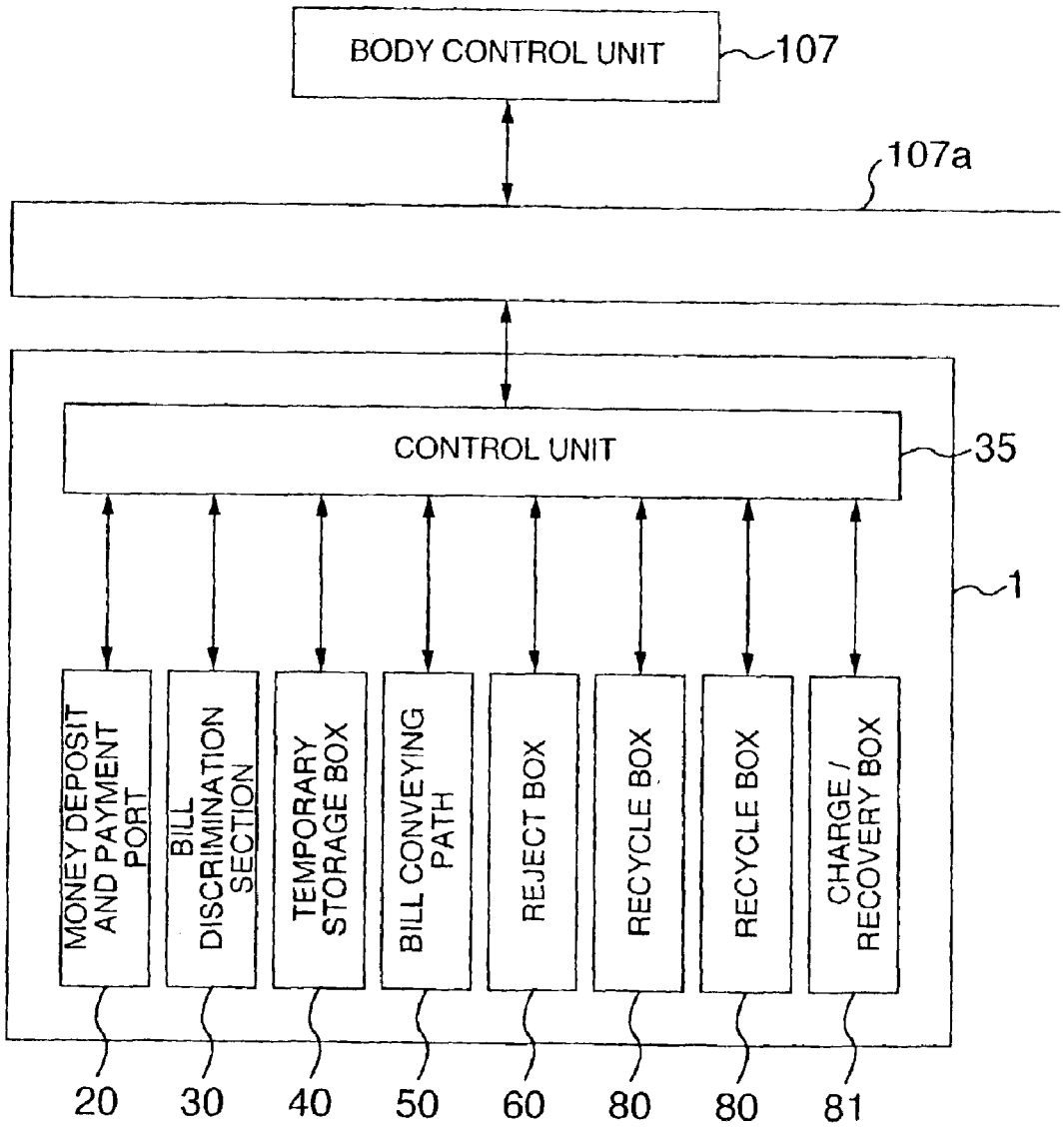
FIG. 4 is a block diagram showing the control relationship of a bill receiving/dispensing mechanism.

As shown in FIG. 4, a control unit 35 is connected to the body control unit 107 to control the bill receiving/dispensing machine 1 in accordance with a command from the body control unit 107 and detection of a state of the bill receiving/dispensing machine 1, and also forwards the state of the bill receiving/dispensing machine 1 to the body control unit 107 at need. Within the bill receiving/dispensing machine 1, the control unit is connected to drive motors, electromagnetic solenoids and sensors for respective units (the money deposit and payment port 20, the bill discriminating section 30, the temporary storage box 40, the bill conveying path 50, the reject box 60, the recycle boxes 80, and the charge/recovery box 81) to drivingly control actuators according to a transaction while monitoring a state by means of the sensors.

As shown in FIG. 3, a conveying path mechanism for the bill receiving/dispensing machine 1 is composed of an upper bill conveying mechanism 1*a* comprising the money deposit and payment port 20, the bill discriminating section 30, the temporary storage box 40 and the bill conveying path 50, and a lower bill conveying mechanism 1*b* comprising the reject box 60, the recycle boxes 80, the charge/recovery box 81 and an openable conveying path 90 arranged in front of the respective storage boxes.

The bill receiving/dispensing machine 1 constructed in the above manner is mounted inside a lower portion of the automatic teller machine 101 as shown in FIG. 1. It is possible to employ a front side operation type or a back side operation type depending upon the type of the machine, and the construction correspondingly varies somewhat. As shown in FIG. 5A, the front side operation type machine, on a front side of which a staff performs operation, is constructed such that a front door 101*c* can be opened and closed, and when, as shown in the figure, the front door 101*c* is opened and the conveying path 90 of the bill receiving/dispensing machine 1 is opened, storage boxes each provided with a handle appear. The staff can pull out the respective storage boxes with the handle to perform operations such as replenishment and recovery of bills, and other maintenance work.

Figure 5B:
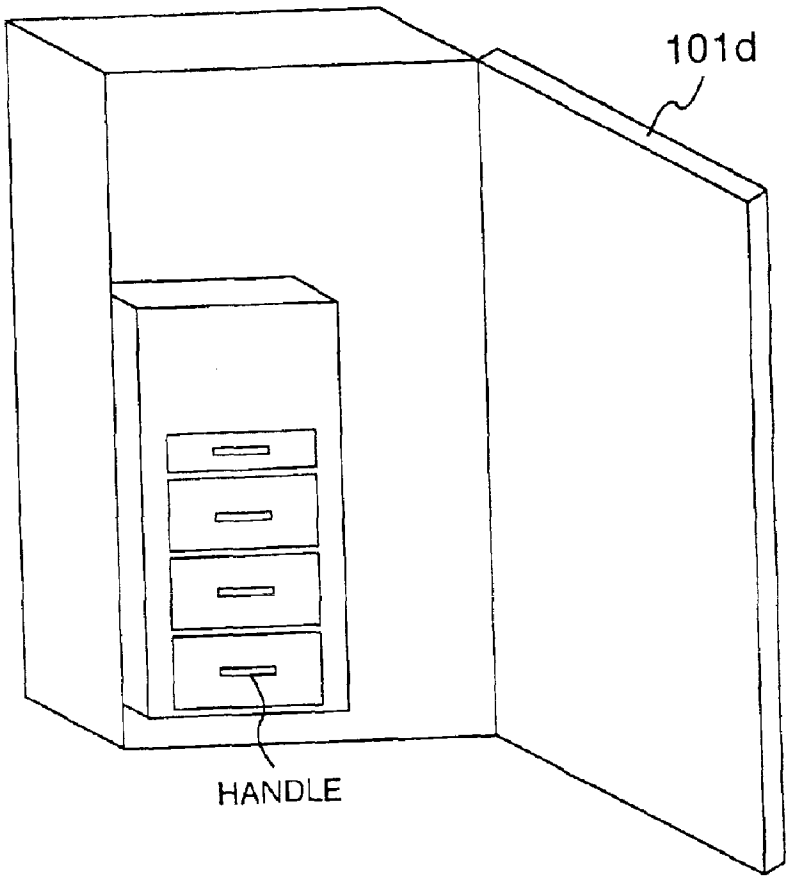
FIG. 5B is a view showing how to operate the automatic teller machine shown in FIG. 1.
Figure 5A:
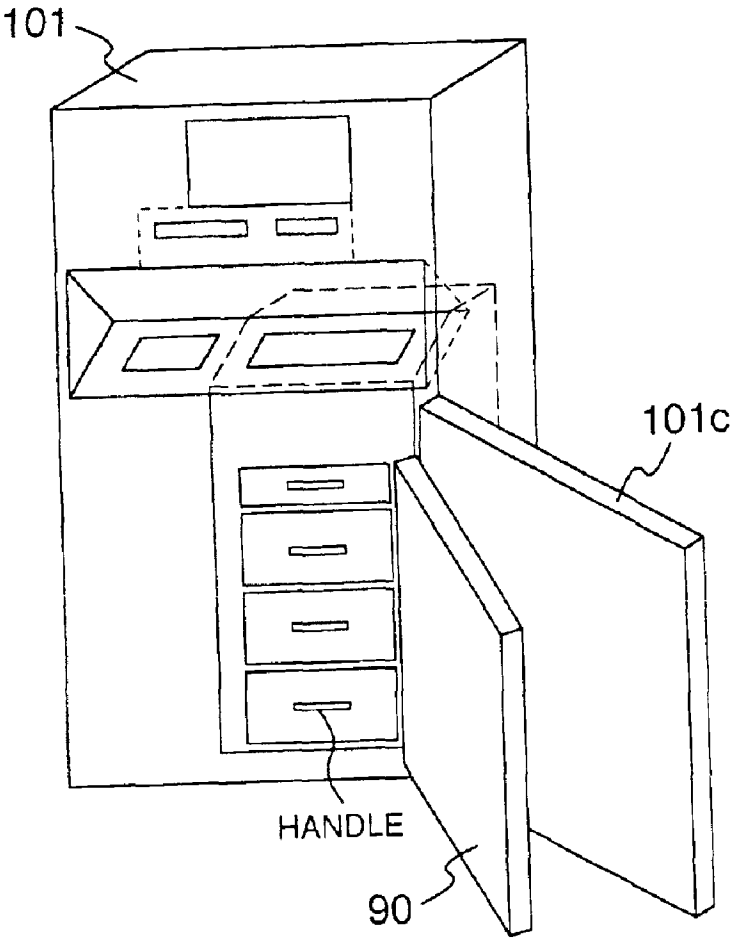
FIG. 5A is a view showing how to operate the automatic teller machine shown in FIG. 1.

Meanwhile, as shown in FIG. 5B, the back side operation type machine, on a back side of which a staff performs operation, is constructed such that a back door 101*d* can be opened and closed, and when, as shown in the figure, the back door 100*d* is opened, the storage boxes each provided with a handle appear. The staff can pull out the respective storage boxes with the handle to perform operation.

Storage portions of the respective units (the money deposit and payment port 20, the bill discriminating section 30, the temporary storage box 40, the reject box 60, the recycle boxes 80, and the charge/recovery box 81) ensure a short side dimension of about 100 mm and a long side dimension of about 200 mm for bills to be capable of handling not only Japanese Yen bills but also foreign bills having different dimensions from those of Japanese Yen bills, and a conveying section (the bill discriminating section 3, the temporary storage box 4, and the bill conveying path 5) ensures a width of about 220 mm.

An explanation will be given below to an action of the bill receiving/dispensing mechanism 1. At the time of deposit transaction, an action of the mechanism includes a deposited money counting action for counting bills deposited by a customer, and a deposited money storage action for storing bills in individual storage boxes every denomination after a customer has confirmed the counted amount of money. In the case where cancellation is chosen after a customer inputs confirmation, the mechanism performs a cancellation/return action.

At the deposited money counting action, bills charged into the money deposit and payment port 20 are separated one by one to be passed along arrows 501*a* and 501*b* to the bill discriminating section 30, where denomination and authenticity of bills are discriminated. The bills having been discriminated are conveyed in directions along arrows 501*d* and 501*e* from arrow 501*c* by switching of a switching gate 503 to be temporarily stored in the temporary storage box 40. A bill or bills, which the bill discriminating section 30 could not discriminate or a bill or bills, of which reception is rejected due to a tilt or abnormal spacings between bills, are not taken into the temporary storage box 40, but are passed along arrow 501*h* by switching of the switching gate 503 to be stored in the money deposit and payment port 20 to be returned to the customer.

At the time of reception and storage of money, a bill or bills are fed from the temporary storage box 40 in the order reverse to and in a direction reverse to those in the deposited money counting action, forwarded along the arrows 501*e* and 501*d* to be conveyed to 501*c* and 501*b* to be passed through the bill discriminating section 30 to go by way of 501*i* and 901*a* by switching of a switching gate 502 to a direction shown by 502*b* to be stored in specified storage boxes by switching of a switching gate 903 of either of the recycle box 80 and the reject box 60 to a direction shown by 903*b*. At the time of cancellation and return, a bill or bills are conveyed along arrows 501*e*, 501*g*, and 501*h* by switching of the switching gate 503 to be stored in the money deposit and payment port 20 to be returned to the customer.

At the time of payment transaction, bills are taken out by predetermined numbers from boxes every denomination of the recycle boxes 80 to go by way of arrows 901*c, b*, and *a* and 501*l* to be discriminated in terms of denomination by the bill discriminating section 30 to be branched at the switching gate 503 to be stored in the money deposit and payment port 20 to be paid to the customer. In the case where rejection of money payment is caused due to impossible discrimination at the bill discriminating section 30, a bill or bills thus rejected are stored in the temporary storage box 40 by switching of the switching gate 503 in the same manner as at the time of deposited money counting action. Bills making up the balance are additionally taken out from the recycle box 80.

Also, with this embodiment, the charge/recovery box 81 can be used to perform charging and recovery actions between the charge/recovery box 81 and the recycle box 80 through the medium of the temporary storage box 40. In the charge operation, a staff does not individually set bills, desired to be set every denomination, in the charge/recycle boxes 80 but collectively sets them in the charge/recovery box 81, and allows them to be automatically stored in the charge/recycle boxes 80 in the machine. First, in the charge counting action, bills taken out from the charge/recovery box 81 pass though 901*a*, 501*i*, and 501*b* to be discriminated in terms of denomination by the bill discriminating section 30, and are temporarily stored in the temporary storage box 40. Then, in the charge storage action, bills are successively discharged from the temporary storage box 40 to go by way of the same bill conveying path in the reverse direction, and are stored in a specified recycle box 80 every denomination. When the number of bills collectively stored in the charge/recovery box 81 is more than those storable in the temporary storage box 40, the charge counting action and the charge storage action are repeated. Also, a bill or bills, of which denomination cannot be discriminated and charging of which is rejected, go by way of 501*j* and 904*b* upon the switching of a switching gate 505 in a direction indicated by 505*b* in the figure and the switching of a switching gate 506 to be stored in a charge reject storage portion rearward in the charge/recovery box 81.

In the recovery action, when the recycle box 80 becomes full or so, a staff does not individually remove bills from the recycle box 80, but a predetermined number of bills are automatically recovered from the recycle box 80 to the charge/recovery box 81 to be stored therein. In this action, bills move via a route reverse to that for the charge action, and so bills from the recycle box 80 are stored temporarily in the temporary storage box 40, and then are recovered from the temporary storage box 40 to the charge/recovery box 81.

An explanation will be given below in detail to the construction and action of the recycle boxes (bill receiving/dispensing boxes) 80 applied to the bill receiving/dispensing mechanism 1 with reference to FIGS. 6 to 10.

Figure 6:
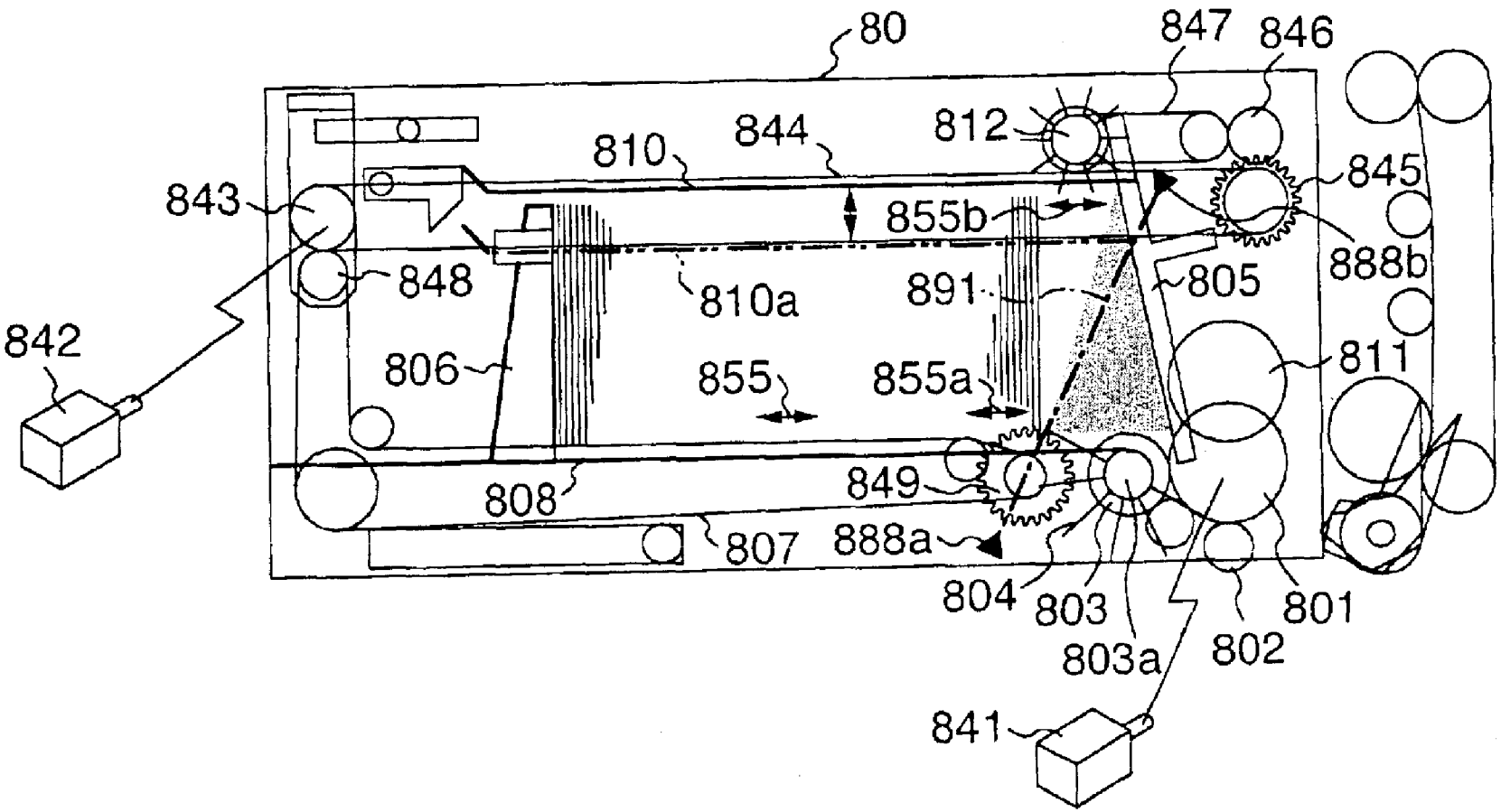
FIG. 6 is a side view showing a recycle box (at the time of separating operation)
Figure 7:
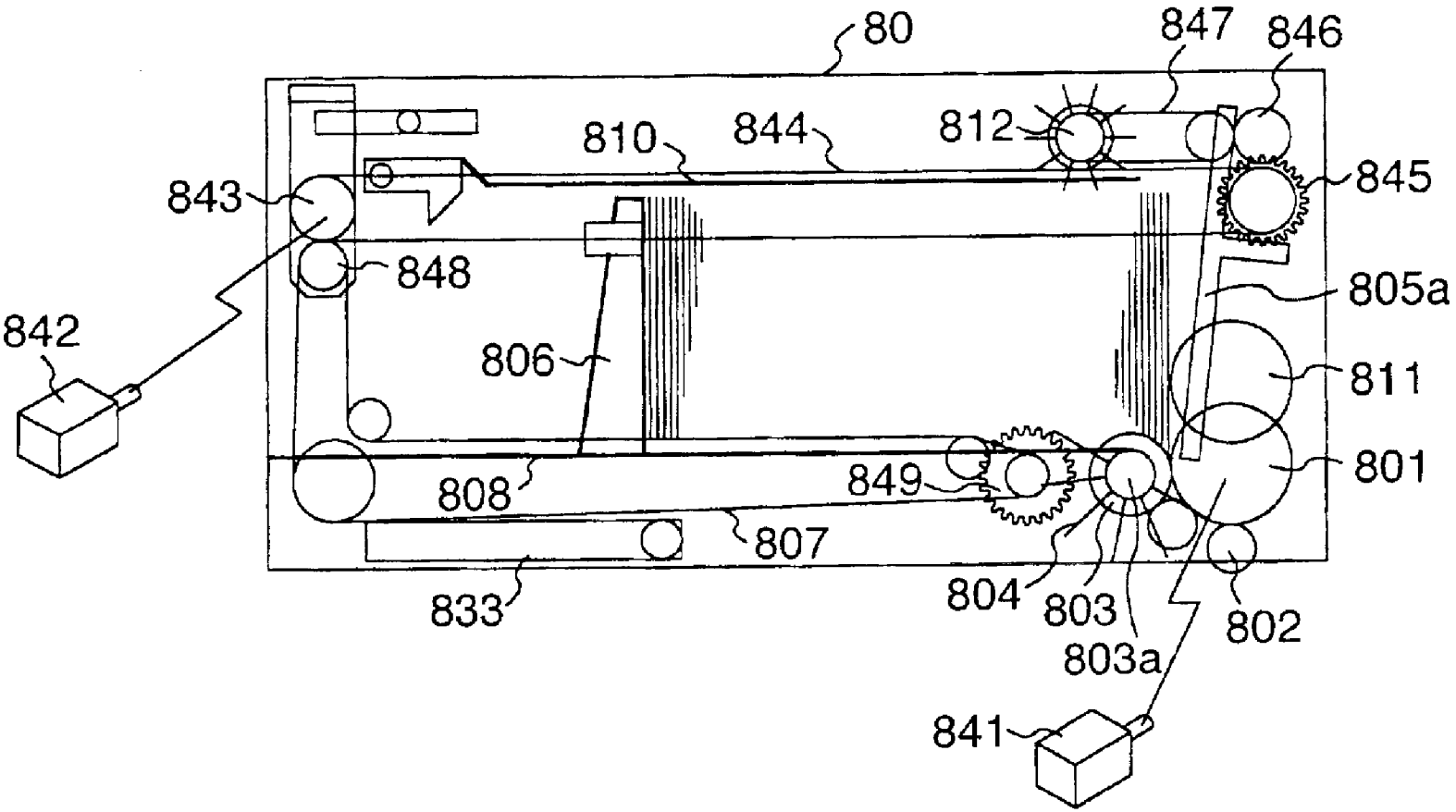
FIG. 7 is a side view showing a recycle box (at the time of stacking operation)
Figure 8:
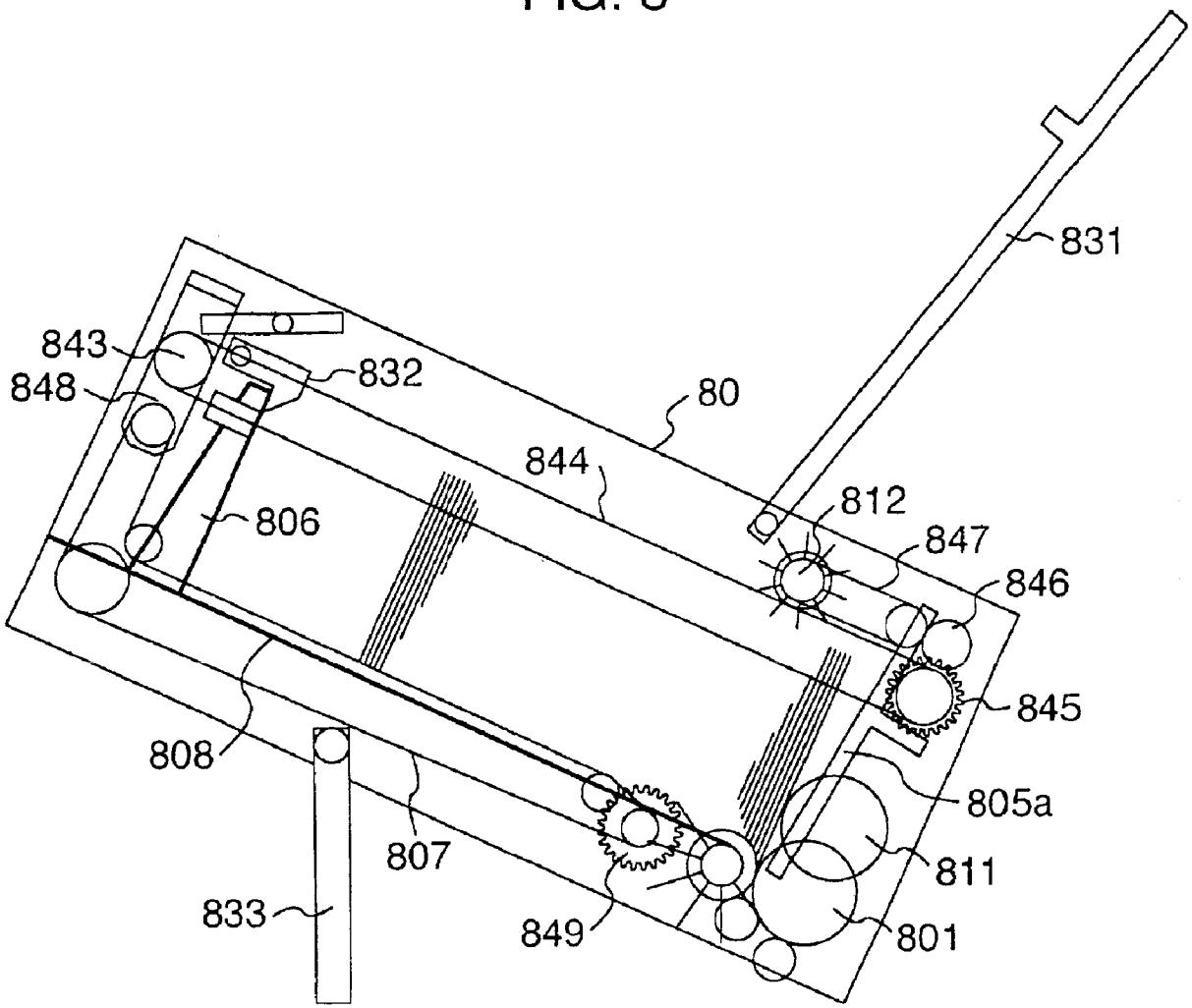
FIG. 8 is a side view showing a recycle box (when a staff operates).

The recycle boxes 80 are capable of storing bills and separating and taking out them, and the bill receiving/dispensing mechanism 1 shown in FIG. 3 is provided with two recycle boxes 80, construction of which is shown in FIGS. 6 to 8. FIG. 6 shows a state in the bill storing action, FIG. 7 showing a state in the bill separating action, and FIG. 8 showing a state when a recycle box 80 is dismounted from the bill receiving/dispensing mechanism 1 to remove bills from the storage section and when bills are charged in the storage section (that is, a staff operates).

The recycle box 80 is mainly composed of a stack feed roller 801 and a pickup roller 811, which are rotatingly driven by a drive source 841 (a feed motor or a step motor) mounted outside of the box through the medium of gears, a backup roller 802 for driven rotation, a gate roller 803 for rotation in a direction of storage and non-rotation in a taking-out direction, a brush roller 804 coaxial with the gate roller 803 and provided with a flexible pushing-in member in a radial manner, and a separation/stack guide 805 (bill guide) movable at the time of separation and stacking, as well as bill stacking and separating mechanisms.

Other layout constructions of the recycle box 80 will be explained. Bills are stored in a storage space enclosed by a bottom plate 808, a push plate 806, a bottom flat belt 807 suspended so as to support lower faces of bills at a higher level than the bottom plate 808, and the separation/stack guide 805. Further, upper and lower ends of bills having been stored are supported by upper bill support members 812 disposed in the vicinity of the separation/stack guide 805 in the upper part of the storage section so as to be associated with the upper part of the separation/stack guide 805, and lower bill support members (not shown, but are present near the reference numeral 849), disposed in the vicinity of the gate roller 803 disposed in the lower part of the storage section.

The push plate 806, the bottom flat belt 807, the upper bill support members 812, the lower bill support members, and the separation/stack guide 805, which move in the storage space, are connected to a shaft 843 from a drive source 842 (push plate motor: step motor) mounted outside of the box, and constitute a push plate motor driving mechanism driven via gears, belts, or the like. The push plate 806 is fixed to a timing belt 844 supported on the sides of the storage space of the recycle box 80 in a longitudinal direction to be driven in a direction indicated by arrow 855, that is, in a longitudinal direction of the recycle box 80 (lateral direction in the figure). The upper bill support members 812 are rotatingly driven in a direction indicated by arrow 855*b* via a gear 846 and a timing belt 847 by a shaft 845 on the front side of the timing belt 844. The separation/stack guide 805 is swingably supported on a rotating shaft of the stack feed roller 801 to be moved between positions shown in FIGS. 6 and 7 via a gear having a torque limiter inserted thereinto and provided on the shaft 845 on the front side of the timing belt 844. The bottom flat belt 807 is driven by a driving force of the drive source 842 transmitted from the shaft 843 to a shaft 848 via a gear. The lower bill support members are constructed integral with a pulley 849 on the front side of the bottom flat belt 807, and is rotatingly driven in a direction indicated by arrow 855*a*.

The upper bill support members 812 supporting upper ends of bills are disposed at two locations in a direction of bill long side, and the lower bill support members supporting lower ends of bills are disposed at four locations in the same way, the both members being acceleratedly driven interlocking with the push plate 806 and the bottom flat belt 807 by the push plate motor 842 in the bill stacking direction or in the non-stacking (separating) direction.

A detailed explanation will be given to an action of the above-described recycle boxes 80.

In the storing action shown in FIG. 6, the switching gate 903 shown in FIG. 3 is switched as at 903*b* in the figure. Thereby, a bill or bills stored in the recycle boxes 80 are branched as shown by arrow 902*b* from the bill conveying path (arrows 901*b, c*). Then, the bill is fed between the rotating stack feed roller 801 and the backup roller 802, shown in FIG. 6. Further, the bill is fed between the stack feed roller 801 and the gate roller 803 rotating in the stacking direction. The bill having been fed between the stack feed roller 801 and the gate roller 803 is stored along the separation/stack guide 805 to be stored in a substantially triangular-shaped stack space 891. Lower ends of the stored bills are scraped in the stack direction by the rotating brush roller 804, whereby interference thereof with succeeding bills is prevented. Further, upper and lower ends of the stored bills are supported by the upper bill support members 812 and the lower bill support members, and the bills are scraped toward the push plate 806. Thereby, bills stored successively in the recycle box 80 from the stack feed roller 801 and the gate roller 803 are maintained in upright position. In addition, the lower bill support members may be in the form of a belt rather than a pulley.

The push plate 806 and the bottom flat belt 807 move together in the storage space, and are controlled in movement in a direction, in which bills stored are spaced away from the separation/stack guide 805, so as to avoid interference between the stored bills and bills being conveyed and entering, as bills stored increase. Transmission sensors (remaining bill detecting sensors) 888*a* and 888*b* are used to monitor an increase in the number of stored bills, and the above control of movement is stopped when continuous dark is detected for a predetermined period of time or longer. At this time, the upper bill support members 812 rotate in a clockwise direction and the lower bill support members rotate in a counterclockwise direction to support upper and lower ends of bills having been stored, thus maintaining the bills in upright position while pushing the bills toward the push plate 806.

As described above, the separation/stack guide 805 is swingably supported on the rotating shaft of the stack feed roller 801, and receives a driving force via the gear 846, in which a torque limiter is inserted, from the shaft 845 on the front side of the timing belt 844. Thereby, the position shown in FIG. 6 is maintained, and the substantially triangular-shaped stack space 891 shown in FIG. 6 is surely formed to allow the stored bills to be surely supported by the above-described upper bill support members 812 and lower bill support members.

When the bottom flat belt 807 is driven together with the push plate 806, a connection shaft (not shown) rotates, so that the moving speed (arrow 855*a*) of the lower bill support members is increased in proportion to the radius ratio of the pulley 849 relative to the moving speed (arrow 855) of the bottom flat belt 807. Likewise, the moving speed (arrow 855*b*) of the upper bill support members 812 is also increased by a mechanism (not shown) relative to the moving speed of the bottom flat belt 807. In this manner, the upper bill support members 812 and the lower bill support members are moved at a speed about 1.2 to 1.3 times the speed of the bottom flat belt 807, that is, the push plate 806 when bills are stored, whereby a compressive force acts on bill being stored, and a continuous storing action is made possible in the stable upright position. Also, this compression action can prevent surplus bulking of stacked bills to increase the storage capacity of bills.

An explanation will be given to the separating action (a state from FIG. 6 to FIG. 7) shown in FIG. 7. As described above, the separation/stack guide 805 is swingably supported on the rotating shaft of the stack feed roller 801. Therefore, the separation/stack guide 805 receives a driving force via the gear 846, in which a torque limiter is inserted, from the shaft 845 on the front side of the timing belt 844, and thus moves to a position shown in FIG. 7. The push plate 806 and the bottom flat belt 807 move together in the storage space to allow the stored bills to move so that bills being taken-out apply a predetermined pressing force on the pickup roller 811. Bills pressed against the pickup roller 811 are forwarded by the rotating stack feed roller 801, and are conveyed one by one in a direction indicated by arrow 902*b* in FIG. 3 while the gate roller 803 not rotating in the take out direction (by the action of a one-way clutch housed therein) is preventing two bills from being fed at a time. At this time, bills are switched in the direction of the switching gate 903*b* to be conveyed in the direction indicated by arrows 901*b* and 901*c*.

Further, after the separating action, the separation/stack guide 805 in the next storing action (a state from that shown in FIG. 7 to that shown in FIG. 6) is swingably supported on the rotating shaft of the stack feed roller 801, and receives a driving force via the gear 846, in which a torque limiter is inserted, from the shaft 845 on the front side of the timing belt 844. Thereby, the separation/stack guide 805 is moved to a position shown in FIG. 6. The push plate 806 and the bottom flat belt 807 are moved together in the storage space by a drive source (not shown) outside the machine, the transmission sensors (remaining bill detecting sensors) 888*a* and 888*b* are used to monitor, and the substantially triangular-shaped stack space 891 shown in FIG. 6 is formed to make the next storing action possible.

In the above-described action effected by a push plate driving mechanism, only the push plate 806 suffices to be movable, for example, in the case where a volume of bills being stored is as small as about 500 sheets, or in the case where bills are new having been short in circulation. However, in the case where a volume of bills is as large as 2000 to 3000 sheets as in this embodiment, and not only new bills but also bills, which have been long in circulation to have wrinkles and bends, low stiffness, and are hard to be maintained in upright position when stacked, due to lack of firmness, are handled, the supporting action provided by the bottom flat belt 807, the upper bill support members 812, the lower bill support members, and the separation/stack guide 805 becomes effective.

FIG. 8 is a view showing a state, in which a staff manipulates the recycle box 80. As shown in the figure, a stand 833 mounted containably on the floor surface of the recycle box 80 is pulled out to make the recycle box oblique at about 20 degrees with respect to a floor surface (not shown). A top cover 831 made integral with a ceiling plate 810 of the storage section in the recycle box 80 is opened as shown in FIG. 8. Then, the push plate 806 is retracted manually to the rearmost position in the storage section to be locked by a push plate lock 832. At this time, connection with the push plate motor 842 shown in FIGS. 6 and 7 is released to allow the push plate 806 to be moved easily. Interlocking with putting the top cover 831 in an opened state, the shaft 848 moves downward to be released from connection with the shaft 843. Therefore, even if the push plate 806 were moved, the bottom flat belt 807 and the lower bill support members 849 would not be driven. Also, Interlocking with putting the top cover 831 in an opened state, connection between the gear 846 and the timing belt 847 is released, so that even if the push plate 806 were moved, the upper bill support members 812 would not be driven.

Thereby, even in the case where bills as many as 2000 to 3000 sheets are to be handled, the bills can be maintained in alignment without falling. An operator can surely operate the push plate 806 to perform charging and removing actions with both hands and with light operating forces.

Next, an explanation will be given to alignment and storage dimensions in a long side direction of small-size bills.

The recycle box 80 can be provided to be made low in cost by a design conformed to largest-size bills being handled and by common use for various denominations of small-size bills. However, as described above, foreign bills are greatly varied in bill size in both long and short side directions depending on denomination, and so in order to ensure a stable continuous bill storing action, addition of the following mechanisms to the recycle box 80 is further effective. A first mechanism is a stopper 810 (roof plate) for restricting upper ends, that is, positions in the short side direction of bill being stored, the stopper being designed to be vertically adjustable together with the upper bill support members 812, as shown in FIG. 6, in accordance with denomination (size of short side) and being adjusted to a position indicated by two-dot chain line 810*a*. Thereby, unevenness in the short side direction can be eliminated.

A second mechanism is capable of adjusting side wall positions of the storage space in conformity with the long side direction of bills being stored. Thereby, unevenness in the long side direction can be eliminated.

Also, mediums handled by the mechanism of the invention may include sheets such as securities, lottery cards, tickets, checks, cards and so on in addition to bills.

As described above, according to the invention, even in the case where a volume of bills is as large as 2000 to 3000 sheets, and not only new bills but also bills, which have been long in circulation to have wrinkles and bends, low stiffness, and are hard to be maintained in upright position when stacked, due to lack of firmness, are handled, (1) it is possible to stably hold such bills in aligned position. Also, (2) it is possible in the separating action to surely conduct stored bills to the separation mechanism section and to separate and take out bills one by one. Also, (3) it is possible in the stacking action to move bills, having been stored, in a direction away from the stacking mechanism section to ensure a storage space for bills being stacked to align and stack the bills. Also, (4) when a staff charges bills in the storage section, it is possible to set the bills in an aligned manner without falling or tilting. Thereby, it is possible to provide a highly reliable bill receiving/dispensing mechanism with good operability.

What is claimed is:

1. A recycle box to be mounted on a bill receiving/dispensing machine including a bill convey path, comprising:

a stacking/separating mechanism arranged to receive bills from the bill convey path so that the bills are contained in the recycle box, and to separate at least one of the bills from the bills contained in the recycle box so that the at least one of the bills is fed to the bill convey path from the recycle box, and a bill guide, which is swingable, arranged in the vicinity of the stacking/separating mechanism, wherein a direction in which the bills are contained in the recycle box by the stacking/separating mechanism is opposite to a direction in which the bills are separated from the recycle box by the stacking/separating mechanism, and wherein the bill guide is swingable between a first position at which the bills is moved away from the stacking/separating mechanism to be contained into the recycle box from the bill convey path and a second position at which the at least one of the bills is moved toward the stacking/separating mechanism to be fed to the bill convey path from the recycle box.

2. A recycle box according to claim 1, wherein the stacking/separating mechanism includes a stack feed roller and a brush roller driven rotationally by a force supplied from the bill receiving/dispensing machine, and the brush roller includes radially extending members.

3. A recycle box according to clam 2, wherein the stack feed roller is rotatable to take the bills into the recycle box from the bill convey path, and the brush roller is rotatable to urge lower ends of the bills so that the bills are stacked in the recycle box.

4. A recycle box according to claim 1, wherein the stacking/separating mechanism includes a stack feed roller and a pick-up roller driven rotationally by a force supplied from the bill receiving/dispensing machine, and a gate roller which is rotatable in one rotational direction and is prevented from rotating in another rotational direction opposite to the one rotational direction.

5. A recycle box according to claim 4, wherein the pick-up roller is rotationally driven to pick up the at least one of the bills from the bills contained in the recycle box, the stack feed roller is rotationally driven to feed the at least one of the bills toward the bill convey path from the recycle box, and the gate roller prevents a plurality of the bills from being simultaneously fed toward the bill convey path from the recycle box.

6. A recycle box according to claim 1, further comprising a push plate arranged at an opposite side with respect to the stacking/separating mechanism and the bill guide in a stacking direction in which the bills are stacked in the recycle box.

7. A recycle box according to claim 6, wherein a volume for containing the bills is formed by the bill guide and the push plate, and the push plate is movable in accordance with operation of the stacking/separating mechanism for stacking and separating the bills in the recycle box.

8. A recycle box according to claim 1, wherein a direction in which the bill to be contained by the recycle box is moved while facing at least partially, in a stacking direction of the stacked bills in the recycle box, to the stacked bills is opposite to a direction in which the bill to be separated from the stacked bills is moved while facing at least partially in the stacking direction to the stacked bills, so that the bill facing at least partially in the stacking direction to the stacked bills proceeds, only at a single side of the stacked bills in a direction perpendicular to the stacking direction, to overlap the stacked bills in the stacking direction and to be separated from the stacked bills.

9. A bill receiving/dispensing machine, comprising:

a money deposit and payment port for receiving bills therethrough into the bill receiving/dispensing machine and paying the bills therethrough out of the bill receiving/dispensing machine, a bill discriminating section for discriminating the received bills a bill convey path for the discriminated bills, and a recycle box connected to the bill convey path, wherein the recycle box comprises a stacking/separating mechanism arranged to receive the bills from the bill convey path so that the bills are stacked into the recycle box, and to separate at least one of the bills from the bills contained in the recycle box so that the at least one of the bills is fed to the bill convey path from the recycle box, and a bill guide arranged in the vicinity of the stacking/separating mechanism and being movable in accordance with operations of the stacking/separating mechanism for stacking and separating, wherein a direction in which the bills are stacked in the recycle box by the stacking/separating mechanism is opposite to a direction in which the bills are separated from the recycle box by the stacking/separating mechanism, and wherein the bill guide is swingable between a first position at which the bills is moved away from the stacking/separating mechanism to be contained into the recycle box from the bill convey path and a second position at which the at least one of the bills is moved toward the stacking/separating mechanism to be fed to the bill convey path from the recycle box.

10. A bill receiving/dispensing machine according to claim 9, wherein the stacking/separating mechanism includes a stack feed roller and a brush roller driven rotationally by a force supplied from the bill receiving/dispensing machine, and the brush roller includes radially extending members.

11. A bill receiving/dispensing machine according to claim 10, wherein the stack feed roller is rotatable to take the bills into the recycle box from the bill convey path, and the brush roller is rotatable to urge lower ends of the bills so that the bills are stacked in the recycle box.

12. A bill receiving/dispensing machine according to claim 9, wherein the stacking/separating mechanism includes a stack feed roller and a pick-up roller driven rotationally by a force supplied from the bill receiving/dispensing machine, and a gate roller which is rotatable in one rotational direction and is prevented from rotating in another rotational direction opposite to the one rotational direction.

13. A bill receiving/dispensing machine according to claim 12, wherein the pick-up roller is rotationally driven to pick up the at least one of the bills from the bills contained in the recycle box, the stack feed roller is rotationally driven to feed the at least one of the bills toward the bill convey path from the recycle box, and the gate roller prevents a plurality of the bills from being simultaneously fed toward the bill convey path from the recycle box.

14. A bill receiving/dispensing machine according to claim 9, further comprising a push plate arranged at an opposite side with respect to the stacking/separating mechanism and the bill guide in a stacking direction in which the bills are stacked in the recycle box.

15. A bill receiving/dispensing machine according to claim 14, wherein a volume for containing the bills is formed by the bill guide and the push plate, and the push plate is movable in accordance with operation of the stacking/separating mechanism for stacking and separating the bills in the recycle box.

16. A bill receiving/dispensing machine according to claim 9, wherein a direction in which the bill to be contained by the recycle box is moved while facing at least partially, in a stacking direction of the stacked bills in the recycle box, to the stacked bills is opposite to a direction in which the bill to be separated from the stacked bills is moved while facing at least partially in the stacking direction to the stacked bills, so that the bill facing at least partially in the stacking direction to the stacked bills proceeds, only at a single side of the stacked bills in a direction perpendicular to the stacking direction, to overlap the stacked bills in the stacking direction and to be separated from the stacked bills.

17. A recycle box to be mounted on a bill receiving/dispensing machine including a bill convey path, comprising:

a stacking/separating mechanism arranged to receive bills from the bill convey path so that the bills are contained in the recycle box, and to separate at least one of the bills from the bills contained in the recycle box so that the at least one of the bills is fed to the bill convey path from the recycle box, and a bill guide, which is swingable, arranged in the vicinity of the stacking/separating mechanism, wherein a direction in which the bills are contained in the recycle box by the stacking/separating mechanism is opposite to a direction in which the bills are separated from the recycle box by the stacking/separating mechanism, and an opening in which the direction in which the bills are contained by the stacking/separating mechanism is opposite to the direction in which the bills are separated from the stacking/separating mechanism.

18. A bill receiving/dispensing machine, comprising:

a money deposit and payment port for receiving bills therethrough into the bill receiving/dispensing machine and paying the bills therethrough out of the bill receiving/dispensing machine, a bill discriminating section for discriminating the received bills a bill convey path for the discriminated bills, and a recycle box connected to the bill convey path, wherein the recycle box comprises a stacking/separating mechanism arranged to receive the bills from the bill convey path so that the bills are stacked into the recycle box, and to separate at least one of the bills from the bills contained in the recycle box so that the at least one of the bills is fed to the bill convey path from the recycle box, and a bill guide arranged in the vicinity of the stacking/separating mechanism and being movable in accordance with operations of the stacking/separating mechanism for stacking and separating, wherein a direction in which the bills are stacked in the recycle box by the stacking/separating mechanism is opposite to a direction in which the bills are separated from the recycle box by the stacking/separating mechanism, and an opening in which the direction in which the bills are contained by the stacking/separating mechanism is opposite to the direction in which the bills are separated from the stacking/separating mechanism.

* * * * *